US006443454B1

(12) United States Patent
Williams

(10) Patent No.: US 6,443,454 B1
(45) Date of Patent: Sep. 3, 2002

(54) BOARD GAME WITH TRIANGULAR PLAYING SPACES FORMING A CROSS-SHAPED PATTERN AND TRIANGULAR SHAPED PLAYING PIECES

(76) Inventor: James Williams, 800 W. Nasa Rd., #268, Webster, TX (US) 77598

( * ) Notice: Subject to any disclaimer, the term of this patent is extended or adjusted under 35 U.S.C. 154(b) by 6 days.

(21) Appl. No.: 09/776,150

(22) Filed: Feb. 5, 2001

(51) Int. Cl.[7] ..... A63F 3/00; A63F 9/20

(52) U.S. Cl. ..... 273/264; 273/236; 273/287; 273/288; 273/293

(58) Field of Search ..... 273/236, 248, 273/249, 272, 278, 264, 287, 288, 293

(56) References Cited

U.S. PATENT DOCUMENTS

| | | | | | |
|---|---|---|---|---|---|
| 2,995,374 | A | * | 8/1961 | Deatherage | 273/248 |
| 4,047,719 | A | * | 9/1977 | Sajkovic | 273/242 |
| 4,146,235 | A | * | 3/1979 | Brautovich | 273/273 |
| 4,515,370 | A | * | 5/1985 | Garcia | 273/258 |
| 4,550,915 | A | * | 11/1985 | Meyer | 273/272 |

FOREIGN PATENT DOCUMENTS

| | | | | |
|---|---|---|---|---|
| FR | 2338728 | * | 8/1977 | 273/292 |
| GB | 2133297 | * | 7/1984 | 273/292 |
| GB | 2141036 | * | 12/1984 | 273/292 |

* cited by examiner

*Primary Examiner*—Benjamin H. Layno
(74) *Attorney, Agent, or Firm*—Kenneth D. Baugh

(57) ABSTRACT

A board game 20 is provided including a support member 22, and a planar shaped game board 36 supported on the support member. The game board 36 is provided with four spaced aligned elongated playing surfaces 40 having twelve numbered triangle shaped numbered spaces 48 formed on each playing surface. A plurality of triangular shaped position spaces 54 are provided on the board 36 adjacent each of the playing surfaces 40. The board game 20 is also provided with forty nine triangularly shaped game pieces 60. The game pieces 60 are formed in seven groups of seven pieces each having distinct surface markings 72. Each game piece 60 is provided with a predetermined pair of numbered designations. The board game 20 is also provided with a set of scoring members 80. The game pieces 60 are used in conjunction with the scoring members 80 and the triangular shaped numbered spaces 48 on the playing surface 40 to score points and implement the game playing strategy for ultimately winning the game.

13 Claims, 4 Drawing Sheets

BOARD GAME WITH TRIANGULAR PLAYING SPACES FORMING A CROSS-SHAPED PATTERN AND TRIANGULAR SHAPED PLAYING PIECES

TECHNICAL FIELD

This invention relates to a board game, and more particularly to a board game including two to four opposing contestants that attempt to fill a cross-patterned board with triangular shaped game pieces to implement game strategy and ultimately to score points.

In an ever growing technically oriented society even games utilized for their entertainment value must be intellectually challenging. Thus games of skill and strategy have become very popular forms of entertainment. Board games have been particularly popular in this regard.

However some of the more popular board games although intellectually stimulating can become somewhat predictable.

In an effort to overcome predictability often the board games are redesigned and combined with game pieces that take non traditional shapes and sizes. However, more open than not these games are made to be more complex, often to the point of being too complex for entertainment purposes.

What is needed is a board game which although intellectually challenging is not so undesirably complex that its entertainment value is lost. One approach to doing this is by providing a game which, expands on some of the traditional game strategies in order to provide a game which allows more opportunities to score and thereby make the game more intellectually stimulating.

BACKGROUND ART

A number of attempts have been made to provide board games to satisfy our ever growing need for entertainment while still finding intellectual stimulation.

One such game is illustrated in U.S. Pat. No. 4,146,235 which discloses a game played on a game board having seven hexagonal areas of equal size. The game also includes thirty six triangular shaped game pieces with dots from one to six. The game is played like a combination of dominos and bridge. The player scores points by completing a hexagon and by getting all their game pieces on the board first.

Another board game is disclosed in U.S. Pat. No. 4,550,915 which discloses a game with triangle shaped game playing elements. The game of this invention is a game of forming words. The game includes a playing surface with a plurality of triangle shaped pieces each marked with a letter, number or symbol or a combination of the above. These game pieces are made for arranging with corresponding shapes on the game board to form words and control the playing strategy of the game.

Although board games such as these may be enjoyable games, games which employ more of the traditional concepts while still expanding on these concepts can be more intellectually challenging and thereby provide more entertainment value.

DISCLOSURE OF THE INVENTION

A board game in accordance with the principles of this invention includes a support member, and a planar member supported on an upper portion of the support member. The planar member has a cross shaped member formed on an upper surface thereof. The cross shaped member is provided with four spaced aligned arms having twelve triangle shaped numbered members formed on each arm. A plurality of triangular shaped position members are provided on the board adjacent each arm of the cross shaped member. The board game is also provided with forty nine triangularly shaped game pieces. The game pieces are formed in seven groups having distinct surface marking. Each game piece is provided with a predetermined pair of numbered designation. The game pieces are used in conjunction with the triangular shaped numbered members in the arms of the cross shaped member to implement the game playing procedure and the strategy for ultimately winning the game.

BRIEF DESCRIPTION OF THE GAME

The details of the invention will be described in connection with the accompanying drawing in which.

DESCRIPTION OF THE PREFERRED EMBODIMENT

Figure 1:
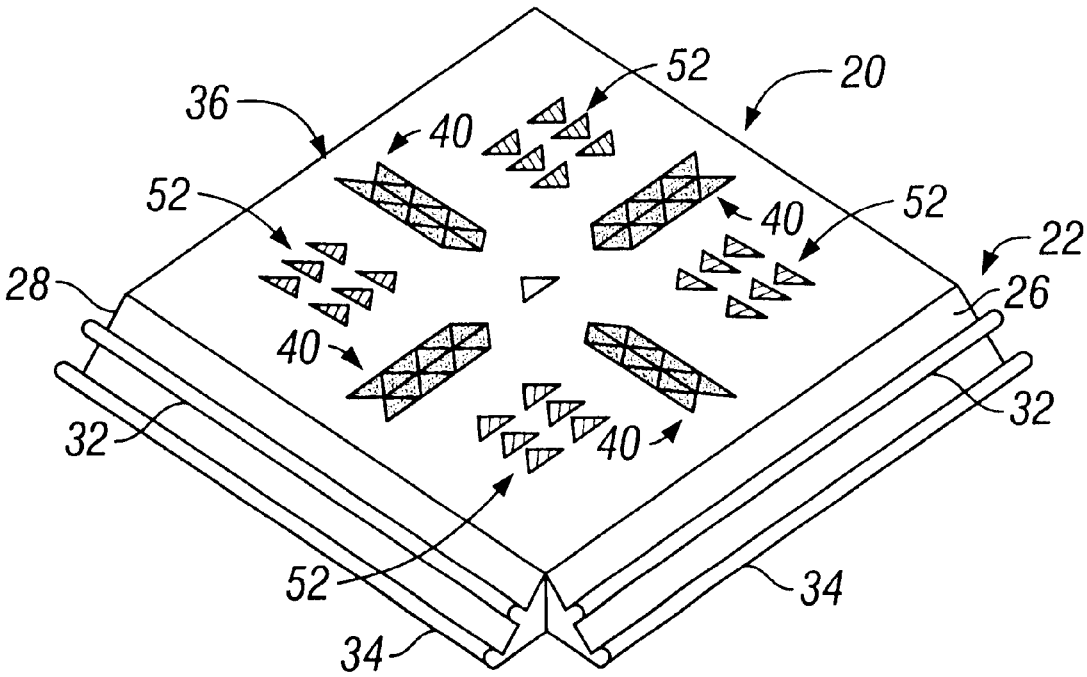
FIG. 1 is a perspective view of a board game in accordance with the principles of the invention.
Figure 2:
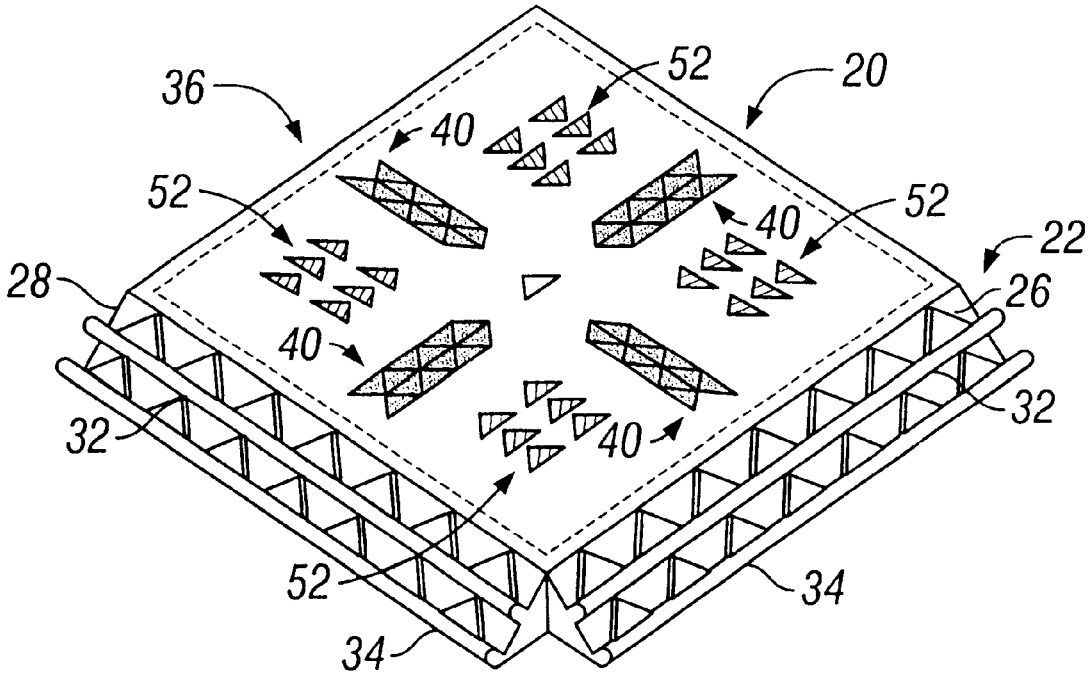
FIG. 2 is another perspective view of a board game in accordance with the principles of the invention.
Figure 3:
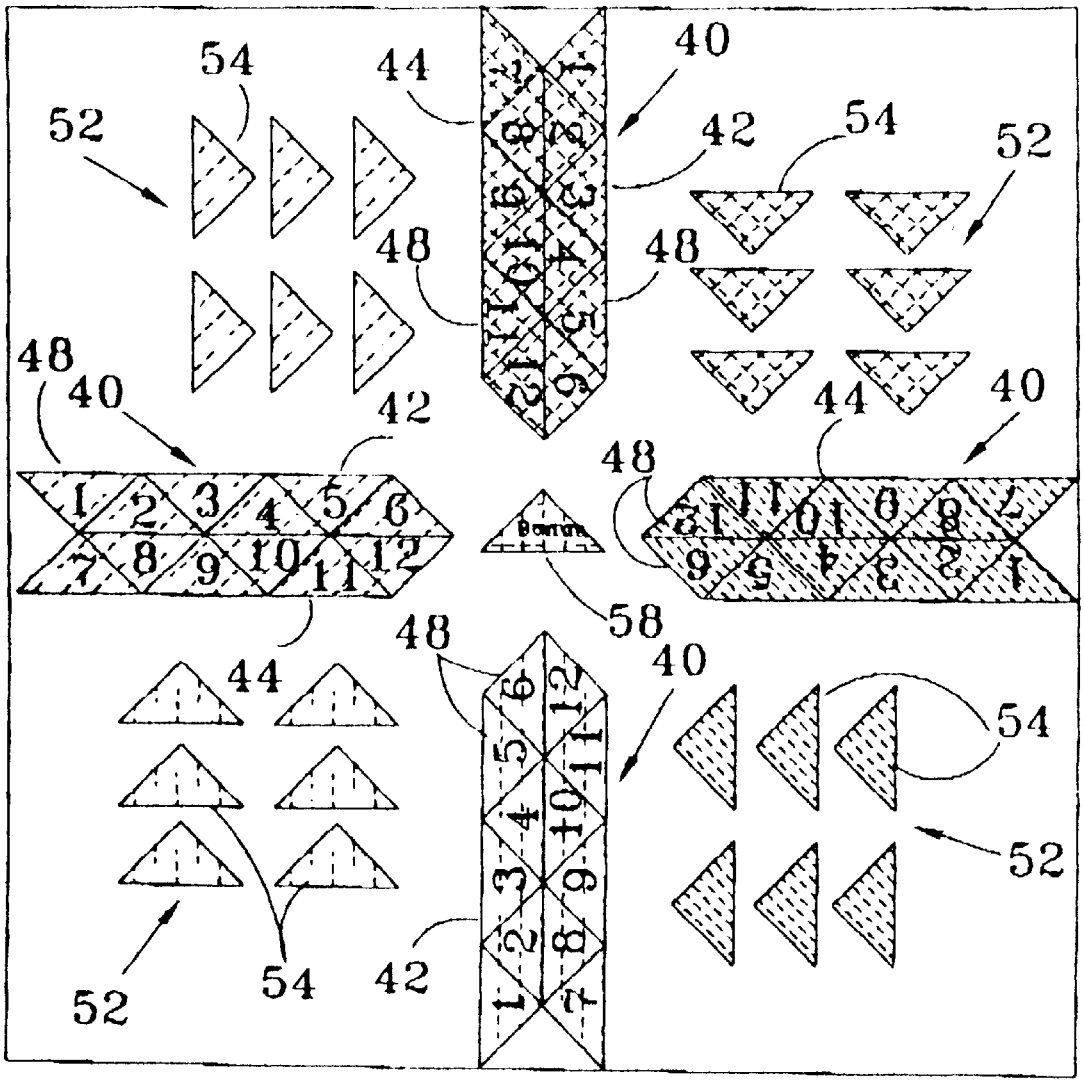
FIG. 3 is a plain view of the game board of the board game in accordance with the principles of the invention.

Referring to FIGS. 1 and 2 there is shown a board game, generally designated, by the numeral, 20. The board game 20 is provided with a rectangular shaped support housing, generally designated, by the numeral, 22. The support housing 22 includes spaced aligned diagonally descending side walls 26 and end walls 28. Each of the walls 26 and 28 is provided with a support ridge 30 (shown in dotted in FIG. 2) which extends outwardly from upper inside portions of the walls. The walls 26 and 28 also include a pair of spaced parallel extending support ridges 32 and 34 formed on intermediate and lower outside portions of the walls. A planar shaped upper member or game board, generally designated, by the numeral, 36 (FIG. 3) is supported between the side walls 26 and the end walls 28 on the support ridge 30 (FIG. 2). The game board 36 is provided with a plurality of spaced aligned elongated playing surfaces, generally designated, by the numeral, 40 formed in a pattern of a cross. Each playing surface 40 is provided with an upper section 42 and lower section 44 having a plurality of adjacently aligned triangular playing spaces 48 formed thereon in a predetermined pattern. There are twelve playing spaces 48 in each playing surface 40. The playing spaces 48 are numbered one through six in the upper section 42 of the playing surface 40, and seven through twelve in the lower section 44 of the playing surface. Each playing surface 40 is also color coded with a different color. For example the playing surfaces 40 may be red, green, blue and yellow.

The game board 36 is also provided with four sets of position slots, generally designated, by the numeral, 52. Each set of position slots 52 includes six triangle shaped spaces 54. One of the sets of position slots 52 is aligned between an adjacent pair of the playing surfaces 40 on the board 36 and are also color coded to correspond to one of the playing surfaces. A triangle shaped space 58 which is designated as a bonus space is formed between and spaced from the playing surfaces 40, on the board 36. The triangle shaped bonus space 58 may be color coded, for example, the color black.

Figure 4:
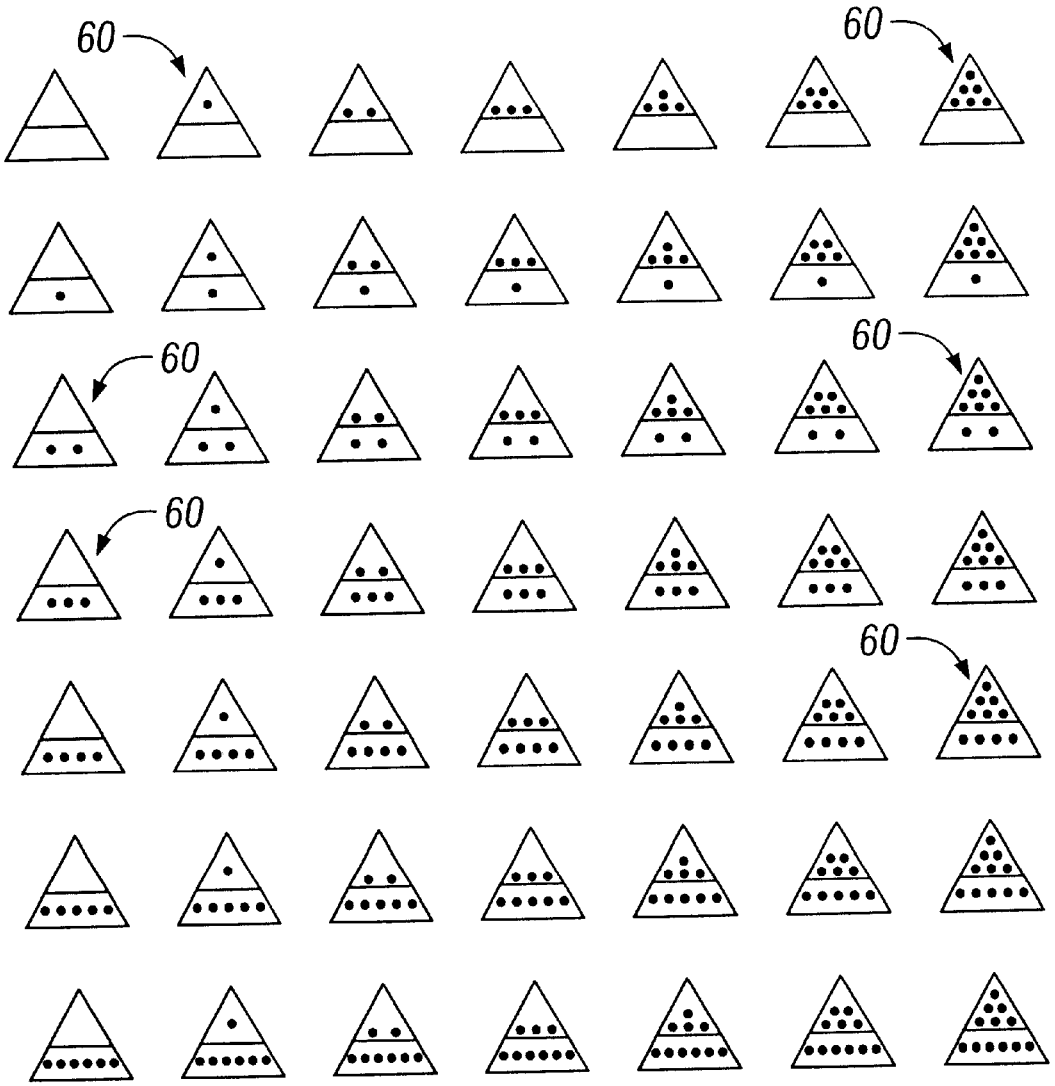
FIG. 4 is a plain view of the forty nine game pieces used for playing the game in accordance with the principles of the invention.
Figure 5:
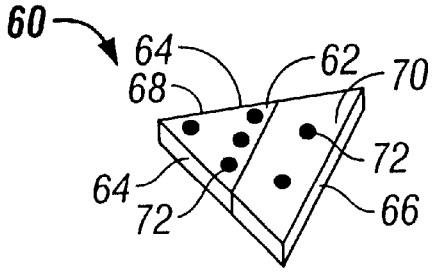
FIG. 5 is a perspective view of one of the forty nine game pieces used for playing the board game in accordance with the principals of the invention.

Referring to FIGS. 4 and 5, the board game 20 is also provided with forty nine triangle shaped game pieces or tiles, generally designated, by the numeral, 60. The game pieces 60 are provided in sets of 7 with seven game pieces per set. Each game piece 60 is provided with an upper surface , generally designated, by the numeral, 62 and lower surface (not shown), corresponding side walls 64 and an end wall 66 (FIG. 5). The upper surface 62 of the game piece 60 is provided with an upper and lower section 68 and 70. Each game piece 60 is also provided wit h a predetermined numerical surface marking which may be displayed in dots 72. The dots 72 on the game pieces 60 are displayed on the upper and lower sections 68 and 70 of the game piece. The dots 72 illustrate a pair of numeric designation from zero-zero (0-0)–six-six (6-6). Accordingly as illustrated in FIG. 4, the seven sets of seven game pieces 60 will have numeric designations in dots 72 from zero-zero (0-0) through zero-six (0-6); from one-zero (1-0) through one-six (1-6); from two-zero (2-0) through two-six (2-6); from three-zero (3-0) through three-six (3-6);

from four-zero (4-0) through four-six (4-6); from five-zero (5-0) through five-six (5-6); and from six-zero (6-0) through six-six (6-6) formed on the upper surface 62 thereof.

Figure 6:
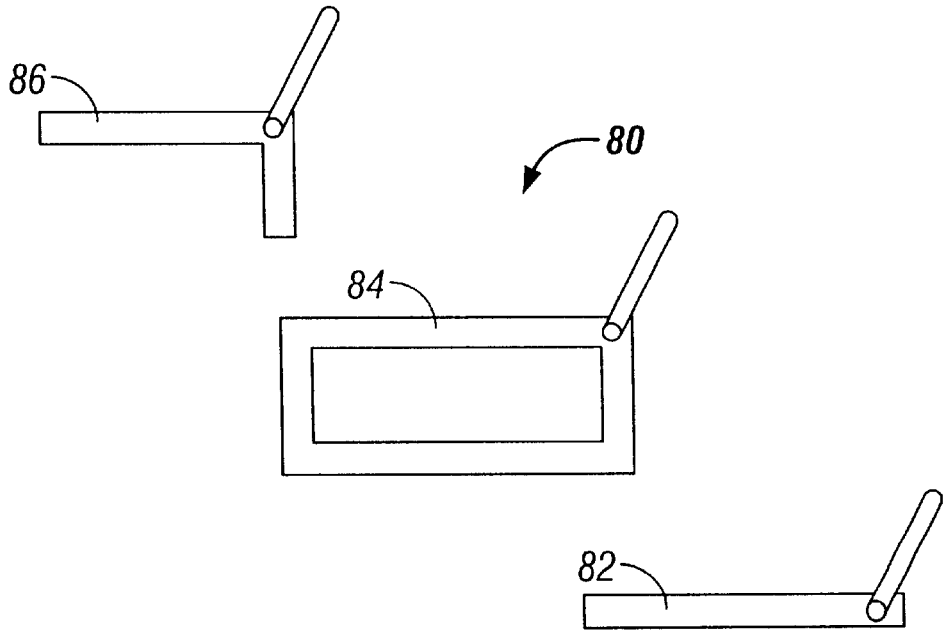
FIG. 6 illustrates the scoring tools used in conjunction with the game piece s to score and implement the game strategy in accordance with the principles of the invention.

Referring to FIG. 6, the game board 20 is also provided with a set of three scoring members, generally designated, by the numeral, 80. The set of scoring members 80 include an elongated scoring member 82, a rectangularly shaped scoring member 84 and a L-shaped scoring member 86. Each player playing the game is provided with a set 80 of the three different shaped scoring members 82, 84 and 86.

The game is played by two to four players. Each player takes a position adjacent to and in front of a side 26 or end 28 of the support member 22 of the game. The game pieces 60 are turned with the dots 72 down so they cannot be seen and mixed or shuffled around on the game board 30 to confuse all players as to the locations of particularly numbered game pieces 60. After shuffling the game pieces 60 each player can pull or pick from 6 to 12 game pieces.

The remaining game pieces 60 that are not pulled or picked by a player (if there are less than four players) are placed face down on any set of the colored position slots 52 on the spaces 54. The forty ninth (49th) game piece is placed on the bonus space 58 only in the event that 12 game pieces maximum have been chosen by four players. Once the game pieces 60 are pulled each player may, if desired, place the game pieces picked by that player on the support ridges 32 and 34 (FIG. 2) so that the pieces are facing that player.

When placed on the ridges 32 and 34 the pieces cannot be seen by opposing players and it allows the players hands to be free to play the game.

Figure 7:
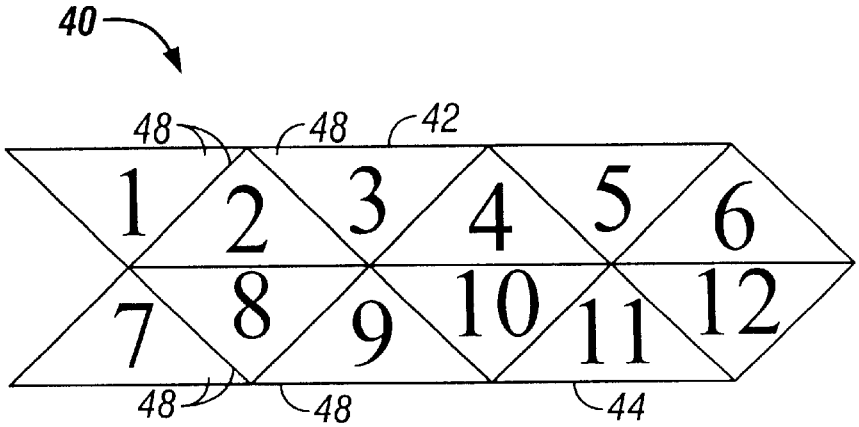
FIG. 7 is an enlargement of one of the playing surfaces of the game board in accordance with the principles of the invention.

When, the game begins the first game piece 60 which is played to start the game always involves the piece having the numerical dotted designation six-six or "Big Six". This game piece 60 may be played at any one of the number one (1) positions on the playing surface 40 on the board 36 (FIG. 7). If no player has the six-six game piece 60 then the next available double numbered game piece is played, such as, for example five-five, four-four, three-three, two-two, one-one or zero-zero. Once the first game piece 60 is played, the next game piece played must match the first game piece. That is this game piece 60 must have an upper section 68 or lower section 70 which has the same numeric designation as the previously played game piece. That is if a six-six (6-6) game piece 60 is played, the second game piece played must match the six-six game piece played (FIG. 8A), and that game piece must be played in the space designated number two (2) (FIG. 7) on the playing surface 40.

Figures 8A, 8B, 8C:
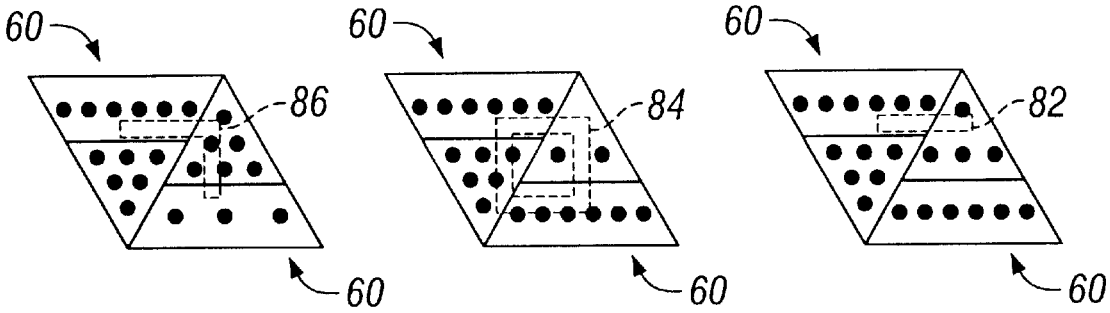
FIGS. 8A–8C are plain views of how the game pieces are used in conjunction with the scoring tools to score and implement game strategy in accordance with the principles of the invention.

Scoring is accomplished in increments of five points and is achieved by one of the three methods using one of three scoring members 80 (FIG. 6). As illustrated in FIG. 8 the scoring members 80 are placed on top of the adjoining game pieces 60 to score and to alert the opposing players of the scoring players method of scoring. In FIG. 8*a*, for example if a player played the six-six (6-6), the next player can score fifteen points by then playing a six-three next to the six-six (6-6), and using the L-shaped scoring member 86. As illustrated scoring is accomplished by placing the member 86 on the two adjacent game pieces 60 so that the total number of dots 72 between the surface of the game pieces touched by the scoring member is fifteen. If a player played a six-two or a two-six next to the six-six, (FIG. 8*b*) and used the rectangular shaped scoring member 84 the player would then score twenty (20) points because the scoring member would touch all surfaces of both game pieces 60. Similarly, if a player had played a six-four (6-4) (FIG. 8*c*) next to the six-six piece and used the elongated scoring member 82, ten points would have been scored.

The game is played by each successive player placing a game piece 60 which matches the previously played game piece on the next consecutively numbered playing space 48 numbered one through six (FIG. 7) until the top section 42 of that particular playing surface 40 has been filled. In the event that during this process the next opposing game player cannot play a matching game piece 60 next to a played game piece, that player must pull one of the unused game pieces 60 from the position spaces 54 one game piece at a time until a piece that can be played has been pulled and played. In the event that no game pieces 60 are available to be pulled, that player must pass their turn to the next player.

When the upper section 42 of a particular playing surface 40 is filled with game pieces 60, the players may then began to play on the lower section 44 of the playing surface. This means the next game piece 60 would be played on the playing space 48 which is numbered seven (#7) by playing a game piece which matches the game piece in the playing space 48 numbered one (1). Once that has occurred the game continues by filling the playing space 48 numbered eight through twelve with game pieces 60.

Once the last position space 48, numbered twelve (12) of a playing surface 40 is filled, the next player can then play at any position space 48 numbered one (1) on any of the remaining playing surfaces 40. At this point, the player can play any game piece 60 of his or her choice. Play continues until the first player has played all of their game pieces 60. When this occurs that player will have the privilege of playing the first game piece 60 after the mixing or shuffling process has been repeated and each player has again picked 12 game pieces 60. The game is continued, with the first player playing a game piece 60 that matches the last game piece 60 played on a playing surface 40 if that playing surface is not filled with game pieces. However, if the playing surface 40 is filled then the player can play any game piece 60 of choice at a playing position 48 numbered one (1) on any of the unplayed playing surfaces 40. This person may play any numbered game piece 60 desired at that position, and may score if desired. The game is continued in this manner until a player is the first to score a predetermined number of points.

The invention has been shown and described in what is considered to be the most practical and preferred embodiment. However, it should be recognized that changes may be made by those skilled in the art without departing from the spirit and scope of the invention.

What is claimed is:

1. A board game including:

a rectangularly shaped support member;

a planar member supported on an upper portion of the support member;

a cross shaped member formed on the planar member having a plurality of elongated members, a plurality of triangle shaped members formed adjacent each elongated member of the cross shaped member; and a plurality of triangle shaped game pieces which are used in conjunction with the cross shaped member to implement game procedure.

2. A board game as defined in claim 1 wherein the cross shaped member includes:

a first elongated arm having a plurality of triangle shaped spaces formed thereon, a second elongated arm having a plurality of triangle shaped spaces formed thereon, and aligned in direct spaced relationship across from the first elongated arm;

a third elongated arm having a plurality of triangle shaped spaces formed thereon aligned in adjacent spaced relationship between the first and second elongated arms; and a fourth elongated arm having a plurality of triangle shaped spaces formed thereon aligned in direct spaced relationship across from the third elongated arm between the first and second elongated arms.

3. A board game as defined in claim 2 wherein each arm of the cross shaped member includes:

an upper portion having six adjacently aligned triangle spaces formed thereon numbered one through six; and a lower portion having six adjacently aligned triangle shaped spaces formed thereon numbered seven through twelve.

4. A board game as defined in claim 3 further including a triangle shaped member formed between the first, second, third and fourth elongated arms and having a predetermined spaced aligned relationship to the elongated arms.

5. A board game as defined in claim 4 wherein rectangularly shaped member includes:

a pair of diagonally descending spaced side walls; and a pair of diagonally descending spaced end walls coupled between the spaced side walls.

6. A board game as defined in claim 5 wherein the side an end walls include a pair of spaced ridges formed on intermediate and lower outside portions of the walls so that the game pieces may be supported thereon.

7. A board game as defined in claim 6 wherein each game piece includes:

an upper wall;

lower wall;

an end wall;

a first diagonally extending side wall;

a second diagonally extending side wall;

the first and second side walls being coupled together at uppermost portions thereof, and lowermost portions of the first side wall being coupled to outermost portions of one end of the end wall and lowermost portions of the second side wall being coupled to outermost portions of another end of the end wall.

8. A game board as defined claim 7 wherein the upper wall of the game piece includes:

a first portion having a first predetermined numeric designation, and a second portion aligned adjacent to the first portion having a second predetermined numeric designation.

9. A game board as defined in claim 8 wherein the plurality of game pieces includes:

a first set of seven game pieces having numeric designations from zero-zero through zero-six, a second set of seven pieces having numeric designations from one-zero through one-six, a third set of seven pieces having numeric designations from two-zero through two-six;

a fourth set of seven pieces having numeric designations from three-zero through three-six;

a fifth set of seven pieces having numeric designations from four-zero through four six;

a sixth set of seven pieces having numeric designations from five-zero through five-six; and seventh set of seven pieces having numeric designations from six-zero through six-six.

10. A game board as defined in claim 9 further including:

a first scoring member having a first predetermined shape;

a second scoring member having a second predetermined shape; and a third scoring member having a third predetermined shape.

11. A game board as defined in claim 10 wherein the first scoring member is an L-shaped member.

12. A game board as defined in claim 11 wherein the second scoring member is an elongated shaped member.

13. A game board as defined in claim 12 wherein the third scoring member is a rectangularly shaped member.

* * * * *